US006952170B2

(12) United States Patent
Aiello

(10) Patent No.: US 6,952,170 B2
(45) Date of Patent: Oct. 4, 2005

(54) HOLLOW DRILLING ROD FOR TRANSMITTING INFORMATION

(75) Inventor: Giovanni Aiello, Nanterre (FR)

(73) Assignee: Compagnie du Sol, Nanterre (FR)

( * ) Notice: Subject to any disclaimer, the term of this patent is extended or adjusted under 35 U.S.C. 154(b) by 624 days.

(21) Appl. No.: 10/054,996

(22) Filed: Jan. 22, 2002

(65) Prior Publication Data

US 2002/0113716 A1 Aug. 22, 2002

(30) Foreign Application Priority Data

Jan. 22, 2001 (FR) ..... 01 00798

(51) Int. Cl.[7] ..... G01V 3/00

(52) U.S. Cl. ..... 340/854.4; 340/854.3; 367/82; 367/83

(58) Field of Search ..... 340/854.3, 854.4; 367/82, 83

(56) References Cited

U.S. PATENT DOCUMENTS 3,518,609 A * 6/1970 Fontenot, Jr. ..... 439/191
3,866,678 A * 2/1975 Jeter ..... 340/854.3
4,012,092 A 3/1977 Godbey
4,496,203 A * 1/1985 Meadows ..... 439/194
4,684,946 A 8/1987 Issenmann
4,899,834 A 2/1990 Weldon
6,763,887 B2 * 7/2004 Boyadjieff ..... 166/302

FOREIGN PATENT DOCUMENTS

EP 0 964 134 12/1999
FR 2 777 594 10/1999

* cited by examiner

*Primary Examiner*—Timothy Edwards, Jr.
(74) *Attorney, Agent, or Firm*—Merchant & Gould P.C.

(57) ABSTRACT

The invention relates to a hollow drilling rod for transmitting information, said rod being for placing in a borehole filled with drilling mud. The rod comprises an electrically conductive cylindrical wall ($52_1$, $52_2$) having an inside face, an outside face, a first end provided with a male coupling sleeve (62), and a second end provided with a female coupling sleeve (60), and being characterized in that it further comprises:

a layer of electrically insulating material (70) covering the inside face over its entire length; and a conductive layer (80) covering said insulating layer and electrically connected at its ends to two electrically conductive rings, said conductive layer itself being covered by a second insulating layer (86) leaving said conductive rings in contact with the drilling mud.

10 Claims, 2 Drawing Sheets

HOLLOW DRILLING ROD FOR TRANSMITTING INFORMATION

The present invention relates to a hollow drilling rod for transmitting information and to a drill string enabling information to be transmitted in this way.

More precisely, the invention provides a drilling rod of the type used for making strings of drilling rods for drilling boreholes in the ground, said boreholes being filled while they are being drilled with a drilling mud, the rods also serving to transmit information between the bottom of the borehole and the surface of the ground.

A drilling installation constituted by drilling rods enabling information to be transmitted between the bottom of the borehole being drilled and the surface of the ground has already been described in French patent No. 2 777 594 in the name of the Applicant. As explained in that document, while the borehole is being drilled, it is very important to be able to transmit to the surface of the ground information that is picked up by sensors mounted in the vicinity of the drilling tool, the drilling tool being fixed to the bottom end of the string of drilling rods.

With reference to accompanying FIG. 1, there follows a description of one of the solutions proposed in the above-mentioned French patent.

FIG. 1 shows a string of drilling rods formed by a bottom rod 10*a*, a top rod 10*b*, and intermediate rods. A drilling tool 12 is fixed to the bottom end of the rod 10*a* and includes measurement sensors 14. The inside face 16 of each rod 10 is coated in a layer of insulating material 18 along the entire length of the drill string. Furthermore, the drill string is naturally located inside the borehole 20 that is being drilled, which is itself filled with a drilling mud 22 that conducts electricity. To enable information to be transmitted, there is a first induction coil 24 disposed close to the bottom end of the rod 10*a* and connected to the measurement sensor 14. There is also an inductive coupling coil 26 mounted inside the top rod 10*b* and connected to conductors such as 28 for conveying the electrical signals picked up by the coil 26 to processor apparatus.

Because of the presence of the insulating layer 16, a closed current loop is established consisting firstly in the drilling mud 30 filling the inside of the rods 10 and secondly in an assembly comprising both the walls of the rods 10 and the mud 32 outside the rods 10.

Alternating current representing information is induced into the current loop by means of the bottom coil 24, and this alternating current is picked up by the receiver coil 26.

It will be understood that the lower the linear resistance of the current loop, the better the system operates. In particular, it will be understood that the system described above with reference to FIG. 1 is very well adapted to circumstances in which the drilling mud presents low linear resistance.

Unfortunately, there exist certain sites where the drilling mud presents linear resistance that is relatively high. It is of course possible to improve the characteristics of drilling mud and to make it conduct better, but that runs the risk of making it more expensive. Furthermore, there exist cases where the use of sea water to improve the conductivity of the mud is not recommended. This applies in particular when large clay layers are present in the soil that is to be drilled. Under such circumstances, the clay layers expand and constrict the borehole. In such soil, it is necessary to use oil-based muds having conductivity that is very low.

It will be understood that it is therefore useful to have a drill string and thus drilling rods that enable the conductivity of the above-defined current loop to be improved regardless of the electrical properties of the drilling mud used.

It will also be understood that there exist cases in which the liquid circulating inside the rods is filled with cuttings from the ground that produce a significant abrasive effect on the inside faces of the rods because they are entrained by the liquid under pressure. This applies during so-called "reverse" circulation of the mud in the borehole, the mud being injected into the annular space between the borehole and the drill string and rising together with the cuttings inside the rods.

A first object of the invention is to provide a drill string which enables information to be transmitted via such a rod regardless of the electrical properties of the mud used for making the borehole, and also avoiding the abrasion phenomenon.

According to the invention, this object is achieved by a hollow rod for transmitting information, said rod being for placing in a borehole filled with a drilling mud, said rod comprising an electrically conductive cylindrical wall with an inside face, an outside face, a first end provided with a male coupling sleeve, and a second end provided with a female coupling sleeve, the rod being characterized in that it further comprises:

- a layer of electrically insulating material covering the inside face of the rod over its entire length;
- a layer of conductive material covering said insulating layer; and
- said layer of electrically conductive material is terminated at each of its ends close to the coupling sleeves by respective conductive rings electrically connected to said conductive layer, and in that said electrically conductive layer is coated on its inside face by a second layer of electrically insulating material, said second layer not covering the inside faces of said rings which come into contact with the drilling mud.

It will thus be understood that over the entire length of a rod, a portion of the current loop is constituted by the conductive layer and by the two conductive rings.

The conductive layer constitutes a kind of short-circuit relative to the mud contained in the rod. At the coupling between two rods, electrical continuity is provided by the mud in contact with the conductive rings of the adjacent rods. Since the distance between two rings is short, that does not give rise to any problem. Furthermore, the conductive layer and the two conductive rings are electrically insulated from the wall of the rod by the insulating layer.

In addition, the conductive layer is mechanically protected by the insulating layer which covers it. Only the inside face of each ring is subjected to the abrasive effect of the liquid circulating in the rod. However these rings are of short length compared with the total length of the rod and they can be made of a conductive material that withstands abrasion.

The drilling rod is preferably characterized in that the length l of each of said conductive rings lies in the range 0.8 D to 2.2 D where D is the inside diameter of said rod.

Also preferably, said layer of insulating material also covers the inside faces of the coupling sleeves, at least over those portions which do not overlap mutually when a drilling rod is assembled to another drilling rod.

A second object of the invention is to provide a string of drilling rods that enables information to be transmitted at least between the bottom end of the string and its top end under conditions that are improved regardless of the electrical properties of the mud filling the borehole that is being made.

To achieve this object, the string of drilling rods for transmitting information at least between the bottom end of the string and its top end is characterized in that it comprises:

a plurality of hollow drilling rods of the above-mentioned type, coupled together via their coupling sleeves;

a drilling tool fixed to the bottom end of the bottom rod of said string;

a first electromagnetic coupling assembly located close to the bottom end of the bottom rod in the axial bore of said rod and suitable for receiving alternating electrical signals representative of information to be transmitted; and a second electromagnetic coupling assembly located in the axial bore of the top rod situated inside the borehole; thus enabling said second assembly to pick up an electrical signal created by current flowing round a current loop constituted firstly by said conductive layers, the conductive ring, and the mud inside said rods, and secondly by the walls of said rods, and the mud outside said rods, said current being created by the signal applied to the first electromagnetic coupling assembly.

Other characteristics and advantages of the invention will appear better on reading the following description of various embodiments of the invention given as non-limiting examples. The description refers to the accompanying drawings, in which:

FIG. 1, described above, is a vertical section through a prior art string of drilling rods for transmitting information;

Figure 1:
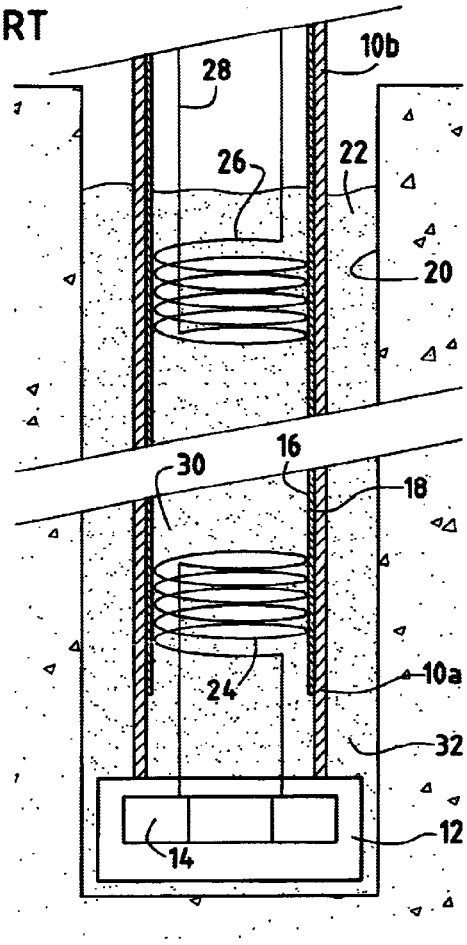
FIG.1 PRIOR ART
Figure 2:
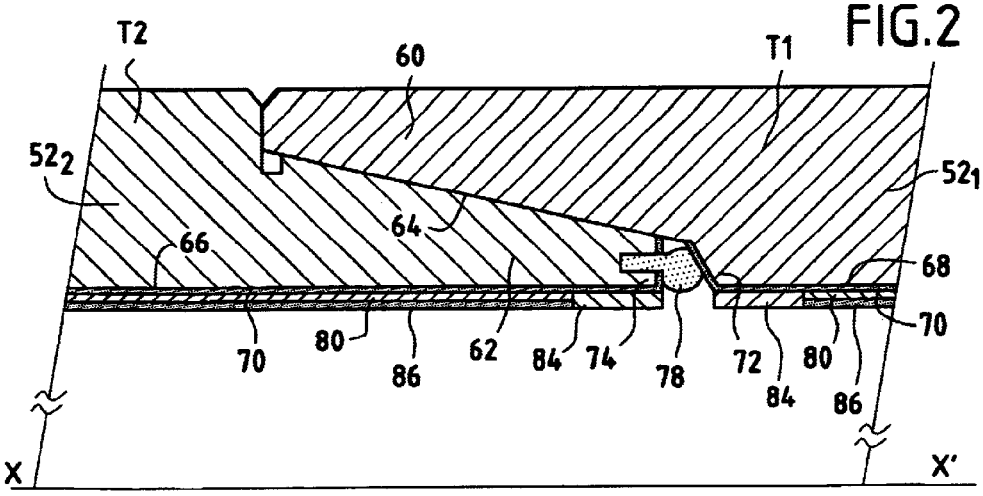
FIG. 2 is a fragmentary longitudinal half-section of a string of two drilling rods in accordance with the invention.
Figure 3:
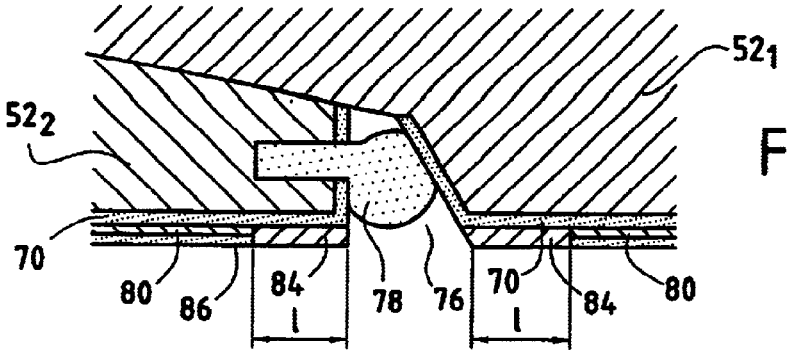
FIG. 3 is a view showing a detail of FIG. 2.

A preferred embodiment of the invention is described with reference to FIGS. 2 and 3. These figures show the walls $\mathbf{52}_1$ of a first rod $T_1$ and the wall $\mathbf{52}_2$ of a second rod $T_2$, with XX' being the common axis of the two rods. This figure also shows more particularly the female coupling sleeve 60 of the rod $T_1$, and the male coupling sleeve 62 of the rod $T_2$, together with the main portions of both rods. In conventional manner, the male and female sleeves are constituted by conical threads 64. The inside face 66 of the rod $T_2$ and the inside face 68 of the rod $T_1$ are both covered in respective insulating layers 70. This insulating layer can be constituted, for example, by a layer of insulating epoxy resin having thickness that is preferably less than 250 micrometers ($\mu$m). More generally, the thickness of the insulating layer depends on the dielectric properties of the material used. The insulating layer 70 is extended over the beginning 72 of the coupling sleeve 60 and over the beginning 74 of the coupling sleeve 62 of the rod $T_2$. In this zone, the two coupling sleeves together define a gap 76. An insulating annular sealing ring 78 secured to the end 74 of the coupling sleeve 62 is preferably installed therein. Once the two rods have been assembled together, the sealing ring 78 is compressed to provide leaktightness.

A conductive layer 80 is provided on the insulating layer 70, the layer 80 extending over the full length of the inside face of the insulating layer with the exception of its portions close to the coupling sleeves.

The conductive layer 80 is electrically connected at its ends corresponding to the coupling sleeves 60 and 62 to annular conductive rings such as 84 which are placed in the vicinity of the coupling sleeves. These rings 84 are insulated from the wall 52 of the rod by the insulating layer 70. Along the main portion of the conductive layer 80 there is a second insulating layer 86 for protective purposes. Naturally, the insulating layer 86 does not cover the conductive rings 84.

It will be understood that the assemblies constituted by the conductive layer 80 and the conductive rings 84 that are electrically connected to the conductive layers 80' constitute a short-circuit relative to the mud contained inside the rod along the length thereof. This result is naturally obtained because the conductive rings 84 are directly in contact with the mud contained inside the rods T, while being electrically insulated from the walls 52 of the rods.

It should be added that electrical continuity between the conductive layers 80 in the vicinity of the gap 76 between two consecutive rods is provided via the rings 84 and the mud under conditions that are entirely acceptable by means of the mud contained in said gap, and regardless of the properties of the mud given the very short length of the gap. It will also be understood that the sequence of conductive layers 80 and of rings 84 is insulated from the walls $\mathbf{52}_1$, $\mathbf{52}_2$ of the rods $T_1$ and $T_2$. The walls $\mathbf{52}_1$, and $\mathbf{52}_2$ together with the mud on the outside of the rods constitutes the return path for the current loop.

The conductive layer 80 can advantageously be constituted by a deposit of conductive epoxy resin of thickness that is likewise of the order of 250 $\mu$m.

The conductive layer 80 can also be made in the following manner.

Starting from a metal tube of length shorter than that of the metallization to be provided (rings 84 to be installed), and having an outside diameter that is slightly smaller than the inside diameter of the wall 52 of a rod, an insulating layer 70 is deposited on the outside face of the tube and also on the inside face of the insulating layer 86. In addition, the tube is of small thickness, no greater than 1 millimeter (mm). The tube is then inserted into the bore of the rod and is prevented from moving, at least in translation, therein. This can be achieved by any suitable means. In particular, it is possible to expand the tube as made possible by its small thickness, by heating it or by applying internal pressure.

In any event, the conductive layer 80 is interrupted at its ends to enable rings 84 to be installed which are electrically connected to the layer 80, e.g. by welding. In this embodiment, the outside faces of the rings 84 are covered in respective insulating layers that extend the insulating layer 70.

The rings 84 are made of a material that presents good electrical conductivity for electrical coupling with the mud, and also good resistance to abrasion. For example, the rings 84 can be made of brass with surface treatment, e.g. nitriding, for the purpose of increasing the surface hardness of the rings.

Preferably, the length of each ring 80 along the rod axis XX' lies in the range 0.8 D to 2.2 D, where D is the inside diameter of the rod. Having a ring of this length provides sufficient electrical contact between the mud and the conductive layer 80 via the rings.

The inside diameter D of the rods can be of the order of 2.5 centimeters (cm) to 5 cm. The length l of the ring is thus of the order of 2.5 cm to 11 cm, which is very small relative to the total length of a rod which is of the order of 9 meters (m) to 10 m. The particular way in which the rings 84 are made therefore does not raise any particular problem given the short length thereof.

Figure 4:
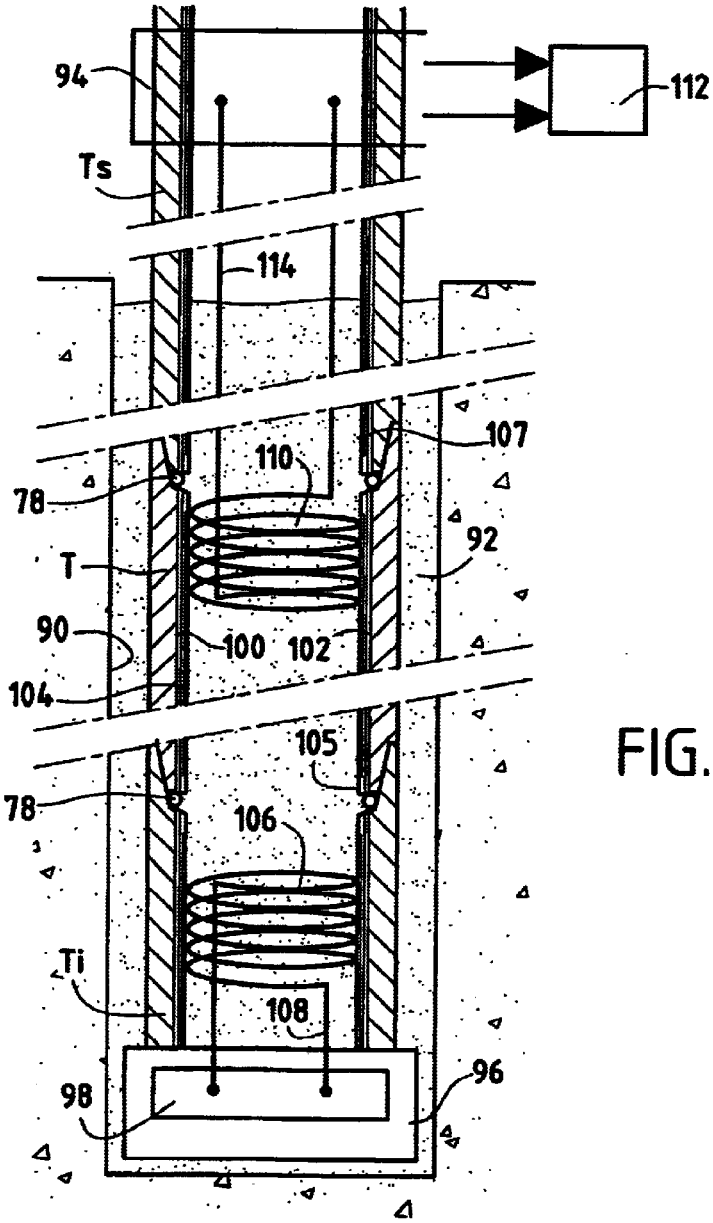
FIG. 4 is a vertical section view of a drill string in accordance with the invention enabling information to be transmitted.

With reference now to FIG. 4, there follows a description of a complete embodiment of a drill string together with information transmission means.

This figure shows a borehole 90 that is being bored and that contains drilling mud 92. In the borehole, there can be seen the drill string constituted by the bottom rod $T_i$, the top rod $T_s$, and the intermediate rods T. In well-known manner, the top rod $T_s$ co-operates with a drilling head 94 serving to set the drill string into rotation and to lower it progressively into the borehole 90. At the bottom end of the bottom rod $T_i$ there is mounted a standard type of drilling tool 96. This drilling tool is fitted with measurement sensors 98. In accordance with the characteristics of the invention, the inside face 100 of each rod T is covered in succession with an insulating layer 102, a conductive layer 104 provided with end rings 105, the end rings coming directly into contact with the mud contained inside the drilling rods, and a second insulating layer 107 covering the main portion of the conductive layer 104. A first electromagnetic coupling coil 106 is mounted inside the bottom rod $T_i$ close to its bottom end. This coil 106 is electrically connected by conductors 108 to the sensors 98 and it acts as a transmitter coil, and optionally as a receiver coil. A second electromagnetic coupling coil 110 is mounted inside the top rod $T_s$. This coil 110 is held below the level of the mud 92 in the borehole. This coil acts as a receiver, and optionally as a transmitter.

As already explained, the set of rods with their conductive and insulating layers define a closed current loop having a first branch constituted by conductive layers 104 and the mud contained inside the rods, and whose second branch is constituted by the walls of the rods themselves together with the mud outside the drill string. These two branches of the current loop are interconnected by the drilling tool 96 at its bottom end and by suitable means at its top end. The bottom coil 106 receives electrical signals from the sensors 98 representative of the measurements performed by the sensors 98. These alternating signals induce current in the above-described closed current loop. This alternating current creates alternating current in the second coil 110 that is likewise representative of the measurement information delivered by the sensors 98, and the voltage created in the coil is conveyed to a processor assembly 112 via electrical conductors 114 and a rotary current collector at the drilling head 94.

What is claimed is:

1. A hollow drilling rod for transmitting information, said rod being for placing in a borehole filled with a drilling mud, said rod comprising:

an electrically conductive cylindrical wall having an inside face, an outside face, a first end provided with a male coupling sleeve, and a second end provided with a female coupling sleeve;

a layer of electrically insulating material covering the inside face of the rod along its entire length;

a conductive layer covering said insulating layer, said layer of electrically conductive material terminating at each of its ends close to the coupling sleeves in a conductive ring which is electrically connected to said conductive layer; and an additional layer of electrically insulating material covering the inside face of said electrically conductive layer, said additional insulating layer not covering the inside faces of said rings which are in contact with the drilling mud.

2. A hollow drilling rod according to claim 1, in which said layer of insulating material also covers the inside faces of the coupling sleeves, at least for the portions thereof which do not overlap mutually when the drilling rod is assembled to another drilling rod.

3. A hollow drilling rod according to claim 1, further comprising an electrically insulating sealing ring secured to one of its male and female coupling sleeves in such a manner that said sealing ring provides leaktightness between a male sleeve and a female sleeve when two rods are assembled together.

4. A drilling rod according to claim 1, in which said layer of insulating material constitutes a coating on the inside face of said rod.

5. A drilling rod according to claim 4, in which said layer of insulating material is made of an insulating epoxy resin.

6. A drilling rod according to claim 5, in which said layer of insulating material is less than 250 $\mu$m thick.

7. A drilling rod according to claim 1, in which said electrically conductive layer is a layer of conductive epoxy resin.

8. A drilling rod according to claim 1, in which the conductive layer is constituted by a tube of conductive material of a thickness that is no greater than a few millimeters, and the insulating layer is constituted by depositing an insulating material on the outside face of said tube, said tube being held stationary inside said rod.

9. A drilling rod according to claim 1, in which the length (l) of each of said conductive rings (84) lies in the range 0.8 D to 2.2 D, where D is the inside diameter of said rod.

10. A string of drilling rods for transmitting information at least between the bottom end of the string and its top end, the string being characterized in that it comprises:

a plurality of hollow drilling rods, each rod comprising:

an electrically conductive cylindrical wall having an inside face, an outside face, a first end provided with a male coupling sleeve, and a second end provided with a female coupling sleeve;

a layer of electrically insulating material covering the inside face of the rod along its entire length;

a conductive layer covering said insulating layer, said layer of electrically conductive material terminating at each of its ends close to the coupling sleeves in a conductive ring which is electrically connected to said conductive layer; and an additional layer of electrically insulating material covering the inside face of said electrically conductive layer, said additional insulating layer not covering the inside faces of said rings which are in contact with the drilling mud, said rods being assembled to one another via their coupling sleeves;

a drilling tool fixed to the bottom end of the bottom rod of said string;

a first electromagnetic coupling assembly placed close to the bottom end of the bottom rod in the axial bore of said rod and suitable for receiving alternating electrical signals representative of information to be transmitted; and a second electromagnetic coupling assembly placed in the axial bore of the top rod situated inside the borehole; whereby said second assembly is suitable for picking up an electrical signal created by current circulating in a current loop constituted firstly by said conductive layer and by said conductive rings and by the mud inside said rods, and secondly by the walls of said rods and the mud outside said rods, said current being created by the signal applied to the first electromagnetic coupling assembly.

* * * * *